United States Patent [19]

Annovi

[11] 4,096,605

[45] Jun. 27, 1978

[54] LACING DEVICE FOR SKI BOOTS

[75] Inventor: Giuseppe Annovi, Montebelluna, Italy

[73] Assignee: Calzaturificio Giuseppe Garbuio S.A.S., Montebelluna, Italy

[21] Appl. No.: 856,192

[22] Filed: Nov. 30, 1977

[30] Foreign Application Priority Data

Dec. 7, 1976 Italy ..... 12922 A/76

[51] Int. Cl.[2] ..... A43B 11/00; A43C 11/00

[52] U.S. Cl. ..... 24/70 SK; 36/50

[58] Field of Search ..... 24/69 SK, 70 SK, 71 SK, 24/81 SK, 68 SK; 36/50, 117

[56] References Cited

U.S. PATENT DOCUMENTS

| | | | |
|---|---|---|---|
| 3,956,796 | 5/1976 | Guolo | 24/70 SK |
| 3,967,391 | 7/1976 | Kastinger | 24/70 SK |
| 4,011,634 | 3/1977 | Olivieri | 24/70 SK |
| 4,020,571 | 5/1977 | Olivieri | 36/50 |
| 4,037,333 | 7/1977 | Olivieri | 36/50 X |

*Primary Examiner*—Louis K. Rimrodt
*Attorney, Agent, or Firm*—Spencer & Kaye

[57] ABSTRACT

In the lacing device for ski boots the lacing members (either one or both of them) are mounted on a U-shaped carrier plate the legs of which slidably engage side grooves provided on an anchoring guide element on the ski boot. On the same carrier plate there is hingedly mounted a clamping element which in its operative position clamps the said legs inserted in the grooves in such a manner as to avoid the possibility that they be stretched apart, or divaricated, thus accidentally coming out of the grooves of the anchoring guide element. The clamping element is constructed as a clamping plate presenting, in correspondence of its sides, downwardly bent edge portions which, when the lacing device is mounted on the ski boot, come to be arranged side by side against the outer sides of the legs of the carrier plate.

6 Claims, 5 Drawing Figures

2
3
207
107
7
8
9
110
310
10
205
105
101
5
305

LACING DEVICE FOR SKI BOOTS

BACKGROUND AND SUMMARY OF THE INVENTION

The present invention relates to a lacing device for ski boots, and more particularly to novel means for anchoring the two members composing the said lacing device to the ski boot.

The modern ski boots are provided with a number of lacing devices each comprising a hooked lever-like member cooperating with a ring-like member. The said members are fastened to base plates, which in turn are secured to the ski boot upper, at both sides of the longitudinal opening formed in the upper, usually by means of rivets.

In the event that one of the said devices becomes irreparably damaged, its substitution is very difficult, and may be accomplished only by a skilled person with the aid of special tools and with the serious risk of damaging the ski boot.

In the U.S. Pat. No. 3,956,796 to GUOLO (patented May 18, 1976) there is shown a lacing device in which the lacing members are mounted each on a base plate which may be assembled and removed with a sliding fit on a guide formed on the ski boot upper. The arrangement according to the mentioned U.S. patent solves the problem of the possibility of easy removal of the lacing member to be substituted, but presents two inconveniences deriving from the fact that the lacing members may be accidentally removed and lost when the lacing device is not closed, and that particularly in the case that relevant stresses are applied to the lacing device, as for example it may happen during ski competitions, the portions of the base plate which slidably engage the guide formed on the ski boot, tend to divaricate, and therefore the lacing member may be accidentally lost.

In the U.S. Pat. No. 4,011,634 to OLIVIERI (patented Mar. 15, 1977) there is shown a lacing device in which each lacing member is mounted on a U-shaped carrier plate, the legs of which engage grooves provided on a guide element obtained on the ski boot. A locking lever is further provided in order to avoid the accidental sliding of the lacing member out of the grooves. However, also for the lacing device according to this patent there remains the problem that the sides of the U-shaped carrier plate tend to divaricate, and consequently the lacing member may be accidentally lost.

In the lacing device for ski boots according to the invention the lacing members (either one or both of them) are mounted on a U-shaped carrier plate the legs of which slidably engage side grooves provided on an anchoring guide element on the ski boot. On the same carrier plate there is hingedly mounted a clamping element which in its operative position clamps the said legs inserted in the grooves in such a manner as to avoid the possibility that they be stretched apart, or divaricated, thus accidentally coming out of the grooves of the anchoring guide element. Practically, the clamping element is constructed as a clamping plate presenting, in correspondence of its sides, downwardly bent edge portions which, when the lacing device is mounted on the ski boot, come to be arranged side by side against the outer sides of the legs of the carrier plate, i.e. the sides of the said legs which are external with respect to the groove engaged thereby.

Still according to another feature, the lacing member presents also a locking portion, which in its simplest form is constituted by the bent-down front edge of the clamping plate, which engages the correspondingly shaped front portion of the anchoring guide element, and thus prevents the accidental sliding of the lacing member out of the grooves of the said anchoring guide element.

BRIEF DESCRIPTION OF THE DRAWINGS

Futher objects and advantages of the lacing device according to the invention will appear evident from the following specification made with reference to the accompanying drawings, in which.

DESCRIPTION OF THE PREFERRED EMBODIMENT

Figure 4:
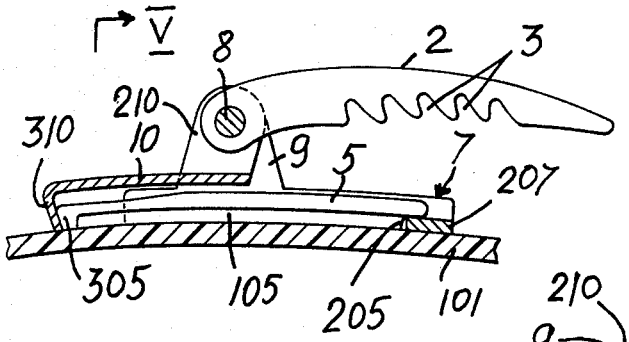
FIG. 4 is a side section of the lacing member, in its assembled position.

With reference to the drawings, reference numeral 1 indicates a ski boot made of plastic material. The ski boot upper is provided, in a conventional manner, with two flaps 101, 201. To the said flaps there must be anchored, or anyhow secured, the lacing devices which are of the conventional type comprising a lever-like lacing member 2 provided with hook indentations 3 on one flap 101, intended to cooperate with a ring-like lacing member 4 on the other flap 201. In order to provide to the anchoring of said lacing members 2 and 4, the flaps 101 and 201 are provided with a plurality of anchoring guides 5 and 6, which project outwardly of the surface of the said flaps. The guides 5 and 6 are arranged in confronting pairs on the flaps 101 and 201, so that a guide 5 of one pair (on flap 101) serves for the anchoring of lacing member 2, while the other guide 6 of the pair (on flap 201) serves for the anchoring of lacing member 4.

In the embodiment shown, the anchoring means according to the invention, for securing the lacing members onto the flaps, have been illustrated only in connection with the lever-like lacing member 2, while the securing of the ring-like lacing member 4 onto the corresponding guide 6 on flap 201 has been illustrated as taking place by engagement of a portion of said ring-like lacing member with a peripheral groove 106 of the guide 6. The above representation has been made for simplicity's sake, and it is to be understood that also the ring-like lacing member 4 can be secured to the flap 201 by adopting the same anchoring means as illustrated in connection with the lever-like lacing member 2.

Figure 5:
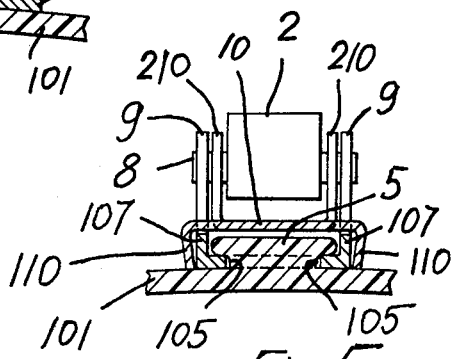
FIG. 5 is a transversal section, taken along line V—V of FIG. 4, of the lacing member in its assembled position.
Figure 1:
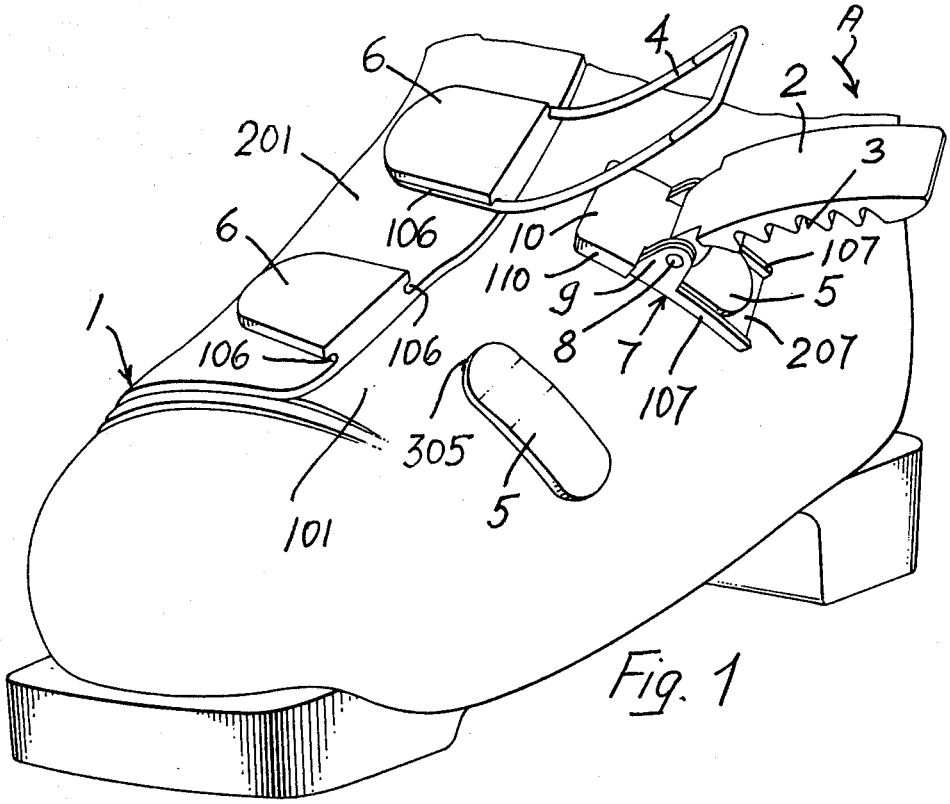
FIG. 1 is a perspective view of the front portion of a ski boot provided with a lacing device according to the invention.

The anchoring guides 5 for the lacing member 2, in the illustrated embodiment, are made of one piece with the ski boot upper, preferably at the moment of the molding of the upper itself, and present a T-shaped profile in cross section, as it may be best appreciated from FIG. 5. The profile of said anchoring guides 5 defines a groove 105 which runs along the said guide 5, below the enlarged head portion defined by the said T-shaped profile, on the two longitudinal sides and in correspondence of the rear side (205), the term "rear" being used to indicate a side or portion which is located farther from the longitudinal opening defined by the flaps, while the term "front" will be used to indicate a side or portion which is located next to the said longitudinal opening.

Each lacing member 2 is carried by a carrier plate 7 presenting in plan view an elongated U-shape, the sides or legs of said U-shaped plate being set at such a distance so as to be capable to slidably engage with some friction the corresponding longitudinal grooves 105 of each guide 5 (see also FIG. 5).

The legs of the U-shaped carrier plate 7 present an upwardly bent edge portion 107 (see particularly FIGS. 2, 3 and 5) which, upon fitting onto the boot of the said carrier plate, results to be perpendicular to the surface of the boot flap, and extends upwardly to a height substantially equal or slightly greater than the height of the anchoring guide 5 above the surface of the said flap. In proximity of the free ends of the legs of the carrier plate 7 there are provided, at each side, upwardly directed lugs 9 for accomodating, in correspondence of their top portion, a transverse pivot pin 8 onto which there is hingedly mounted the lever-like lacing member 2. On the said pivot pin 8 there is also hingedly mounted, by means of lugs 210, the clamping element 10 in the form of a small plate presenting, in correspondence of its front and side edges, peripheral portions 110, 310 downwardly directed.

Figures 2, 3:
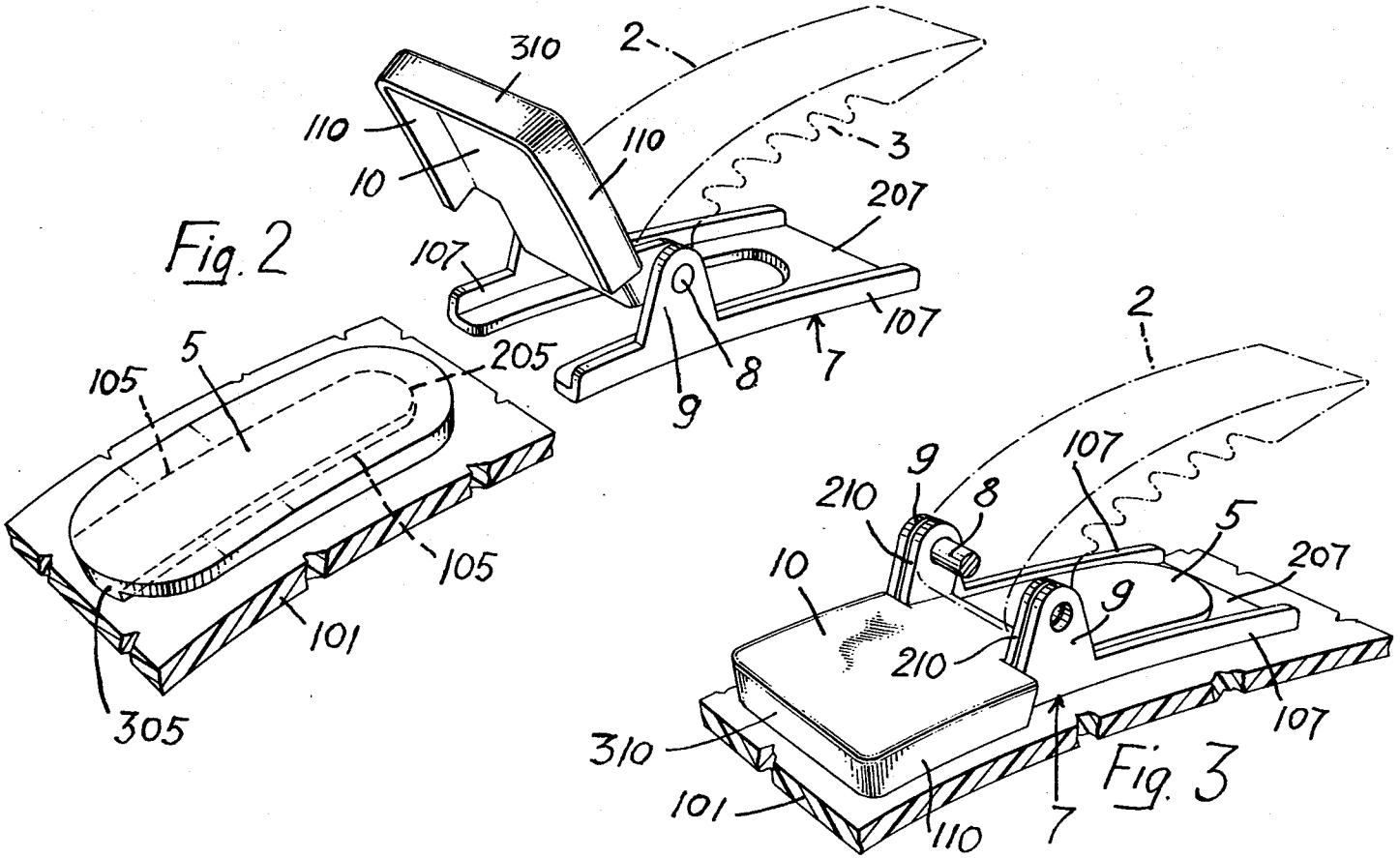
FIG. 2 is a perspective view showing an enlarged detail of a lacing member disassembled from the ski boot.
FIG. 3 is a perspective view similar to that of FIG. 2, showing the lacing member assembled on the ski boot.

The anchoring of the just described lacing device is simple and evident:

The carrier plate 7 is fitted onto the anchoring guide 5, by sliding along the longitudinal grooves 105 of the guide 5, until its rear portion 207 engages the grooved rear portion 205 of the said anchoring guide 5, as clearly shown in FIGS. 2, 3 and 4. The clamping plate 10 is then pressed down so as to closely fit on the forward portion of the anchoring guide 5 and of the legs of the U-shaped carrier plate 7, practically incapsulating same, as it clearly appears from FIGS. 3, 4 and 5. In this manner, while it is avoided the accidental removal of the carrier plate 7 by rearward sliding thanks to the locking action of the front portion 310, it is also avoided that, as a consequence of relevant stresses, the legs of the carrier plate 7 may be divaricated with consequent accidental removal of the carrier plate 7 from the anchoring guide. As it clearly appears from FIG. 5, the downwardly directed side portions 110 of the clamping plate 10 come to be arranged side by side against the upwardly bent edge portions 107 of the carrier plate 7, and therefore clamp same in their parallel position, avoiding, as above mentioned, the possibility of stretching apart.

The clamping plate 10 can be maintained in its locking (incapsulating) position by frictional engagement of the side portions 110 against the edge portions 107 of the carrier plate, or by a snap fit between the downwardly directed front portion 310 (see particularly FIG. 4) which is slightly bent towards the interior, and cooperates with a correspondingly shaped front portion 305 of the anchoring guide 5.

Also the side portions 110 of the clamping plate 10 may be slightly bent inwardly (see FIG. 5), to favour the snap fit locking of the said clamping plate.

It is believed that the invention will have been clearly understood from the foregoing detailed description of a preferred embodiment. Changes in the details of construction may be resorted to without departing from the scope of the invention as set forth in the appended claims.

I claim:

1. In a ski boot of the type comprising a ski boot upper provided with two flaps defining an opening, a lacing device including a hooked lever-like lacing member provided on one flap and intended to cooperate with a ring-like lacing member on the other flap, anchoring means for securing at least one of said lacing members hingedly and in a removable manner onto the corresponding flap, said anchoring means comprising:

(a) an anchoring guide element in the form of a projection provided on the flap and presenting two side grooves arranged transversally with respect to the opening;

(b) a carrier plate onto which there is hingedly mounted the lacing member, said carrier plate presenting two extensions or legs capable of slidably engaging the side grooves provided on the anchoring guide element;

(c) a clamping element provided on said carrier plate, presenting two clamping portions which, in the operative position of the said clamping element, are arranged against the outer sides of the legs of the carrier plate, i.e. the sides which are external with respect to the grooves engaged by the said legs, so as to avoid the divarication of the said legs out of the said grooves.

2. A lacing device according to claim 1, in which the clamping device is constructed as a clamping plate, hingedly mounted on the carrier plate on the same hinge axis of the lacing member, and the clamping portions are formed as bent edges of said clamping plate.

3. A lacing device according to claim 1, in which the clamping element further presents a locking portion capable of engaging a corresponding part of the anchoring guide element in order to avoid the sliding of the legs of the carrier plate out of the grooves of the anchoring guide element.

4. A lacing device according to claim 3, in which the engagement of the locking portion on the corresponding part of the anchoring guide element is a snap fit engagement obtained by suitable inclination of the cooperating surfaces of the locking portion and of the anchoring guide element.

5. A lacing device according to claim 1, in which the clamping plate is maintained in its operative position by snap fit engagement obtained through the cooperation of suitably inclined surfaces of the clamping portions and of the outer sides of the legs of the carrier plate.

6. A lacing device according to claim 1, in which the carrier plate is constructed as a U-shaped plate, provided with two legs which, in correspondence of their outer sides, present edge portion bent at right angles with respect to the surface of the said plate.

* * * * *